US006019189A

United States Patent [19]

Shima et al.

[11] Patent Number: 6,019,189

[45] Date of Patent: Feb. 1, 2000

[54] NOISE BARRIER WALL

[75] Inventors: Hiroshi Shima; Toshiyuki Watanabe, both of Tokyo; Koich Matsumoto, Kanagawa-ken; Kunio Nakasaki, Tokyo; Toshikazu Osafune, Kanagawa-ken, all of Japan

[73] Assignees: Bridgestone Corporation; Nihon Doro Kodan, both of Tokyo, Japan

[21] Appl. No.: 09/026,136

[22] Filed: Feb. 19, 1998

[30] Foreign Application Priority Data

Feb. 19, 1997 [JP] Japan ..... 9-052383

[51] Int. Cl.[7] ..... G10K 11/00

[52] U.S. Cl. ..... 181/210

[58] Field of Search ..... 181/284, 286, 181/287, 210; 52/144, 145, 169.1, 169.3, 169.4

[56] References Cited

U.S. PATENT DOCUMENTS

| | | | |
|---|---|---|---|
| 4,308,933 | 1/1982 | Hahn et al. | 181/210 |
| 4,436,179 | 3/1984 | Yamamoto et al. | 181/210 |
| 5,678,364 | 10/1997 | Shima et al. | 181/210 |
| 5,739,482 | 4/1998 | Shima et al. | 181/210 |

*Primary Examiner*—Khanh Dang
*Attorney, Agent, or Firm*—Jordan and Hamburg LLP

[57] ABSTRACT

A noise barrier wall is provided which has a main wall body standing generally vertically and provided atop thereof with a first sound absorbing unit, and on a side thereof opposite to a noise source with an overhang extending away from the noise source and of which the free end is directed upward and provided at an end thereof with a second sound absorbing unit. Each of the first and second sound absorbing units comprises two branch walls extending obliquely upward to the left and right, respectively. Each of the two branch walls is provided with an additional branch wall. These additional branch walls extend obliquely upward towards each other. An opening is defined between free ends of the additional branch walls.

3 Claims, 6 Drawing Sheets

NOISE BARRIER WALL

BACKGROUND OF THE INVENTION

1. Field of the Invention

The present invention relates to a sound barrier wall for use along roadways, railroads, factories, etc. to reduce a noise coming from such source.

2. Description of the Prior Art

For controlling noises from roadways, railways, factories, etc., sound or noise barrier walls have so far been proposed for preventing direct propagation of a noise from such source. Among a wide variety of noise control structures having been proposed for such purposes, the noise barrier wall is relatively inexpensive and effective for deadening sounds from various sources. For a higher effect of noise control, the noise barrier wall should be correspondingly higher. However, the increased height of the barrier wall will add to the costs of noise control (including the cost of fabrication, installation and maintenance, etc.), and also raise many problems such as the shading of sunlight, blocking of viewing, claustrophobia, poor ventilation, radio jamming, air turbulence, etc.

For a higher effect of noise control than attainable only by a straight wall structure of noise barrier, there are currently available a top bent type noise barrier wall of which the top end is bent towards a noise source, a curved type one of which the top end is curved towards a noise source, and the like. However, these types of noise barrier walls raise more serious problems than mentioned above.

Recently, the traffic volume has increased more and more and the traffic speed has become increasingly high, so that the environmental pollution by noises has become a more serious social problem. However, there have not yet been proposed any other effective solutions to the serious problem of traffic noise. Sound barrier walls of the above-mentioned straight type, top-bent type and curved type are still used which are designed to have an increased height of 5 m, 7 m or 10 m only for the purpose of noise deadening, while the above-mentioned problems incidental to the increase of wall height remain unsolved.

Such increasing the noise barrier wall height permits only an improvement of sound attenuation for the added wall height. Generally speaking, the relationship between a sound attenuation by a noise barrier wall and a height of the wall is such that an incrementing in height by 1 m of the wall will result in an attenuation of about 1 dB as measured at a position 20 m or so away from a noise source.

FIG. 1 shows a conventional soundproof wall structure. As shown, the soundproof wall has a main wall 100 which stands generally vertically. The main wall 100 is provided atop thereof with a first branch wall 101 inclined towards a noise source, and also a second branch wall 102 extending obliquely in a direction opposite to the noise source. The first branch wall 101 is provided with an additional branch wall 103, while the second branch wall 102 has an additional branch wall 104. Owing to this configuration, the soundproof wall effectively acts to attenuate both a noise propagating upward from below and a one traveling downward from above, without the necessity of increasing the height thereof.

However, it has been proved that the prior-art soundproof wall as shown in FIG. 1 is limited from being further reduced in height, and that no satisfactory effect of attenuation can be expected when the wall is used against a sound of a frequency within a certain range since the noise having come into the space between the additional branch walls 103 and 104 is repeatedly reflected between the branch walls and the reflected sounds resonate with each other to cause a further noise.

SUMMARY OF THE PRESENT INVENTION

Accordingly, the present invention has an object to overcome the drawbacks of the above-mentioned prior arts by providing a noise barrier wall showing an excellent effect of noise attenuation even with a reduced height of the entire wall and which can prevent a resonance-caused noise which could not be avoided in the prior art.

The above object can be accomplished by providing a noise barrier wall having a main wall body standing generally vertically and provided atop thereof with a first sound absorbing unit, and on a side thereof opposite to a noise source with an overhang extending away from the noise source and of which the free end is directed upward and provided at an end thereof with a second sound absorbing unit, the first sound absorbing unit comprising two branch walls extending obliquely upward to the left and right, respectively, from the top end of the main wall body and each provided at the free end thereof with an additional branch wall, these additional branch walls extending obliquely upward towards each other, an opening being defined between free ends of the additional branch walls; and the second sound absorbing unit comprising two branch walls extending obliquely upward to the left and right, respectively, from the top end of the overhang and each provided at the free end thereof with an additional branch wall, these additional branch walls extending obliquely upward towards each other, an opening being defined between free ends of the additional branch walls.

According to an aspect of the present invention, the two absorbing units are different in internal space size from each other for different resonant frequencies in the sound absorbing units to prevent a further noise from being caused by a resonance between the frequencies.

Owing to the construction of the noise barrier wall according to the present invention, the wall can provide an improved effect of noise attenuation without being increased in total height.

Also, the two sound absorbing units are designed to have different internal space sizes so that as the sound absorbing units have different resonant frequencies in their respective internal spaces, it can be avoided that the effect of noise attenuation is caused to decrease by an interference between resonant frequencies within a certain range incidental to the noise barrier walls.

Furthermore, the opening of the sound absorbing unit located at a position opposite to a noise source with respect to the main wall body is disposed at a higher level than that of the sound absorbing unit nearer to the noise source, so that the noise propagating from the noise source to the side of the noise barrier wall opposite to the noise source can be suppressed more effectively.

Moreover, the branch wall of the first sound absorbing unit that faces the overhang is disposed not to be parallel with the overhang so that no standing wave will take place within a space defined between the branch wall and the overhang.

BRIEF DESCRIPTION OF THE DRAWINGS

These objects and other objects, features, aspects and advantages of the present invention will become more apparent from the following detailed description of the present invention when taken in conjunction with the accompanying drawings, in which.

DETAILED DESCRIPTION OF THE PREFERRED EMBODIMENTS

Figure 1:
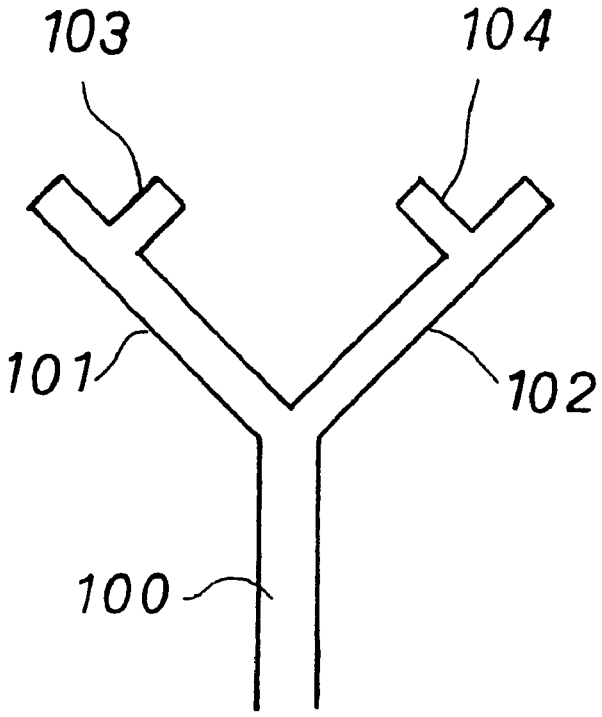
FIG. 1 (PRIOR ART)
FIG. 1 is a side elevation of a prior-art noise barrier wall.
Figure 2:
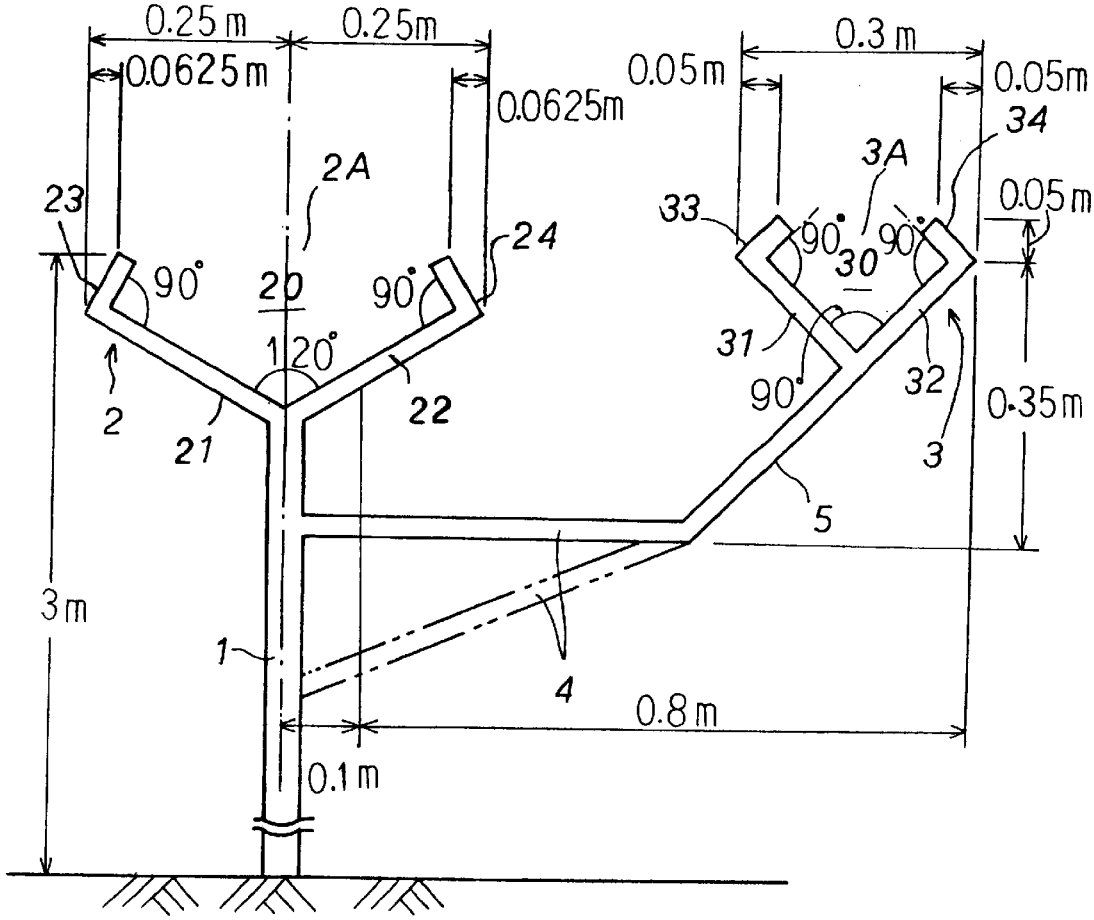
FIG. 2 is a side elevation of a first embodiment of the noise barrier wall according to the present invention.

Referring now to FIG. 2 showing the first embodiment of the present invention, the noise barrier wall has a main wall body 1 standing nearly vertically, and two sound absorbing units 2 and 3, one provided atop the main wall body 1 and the other disposed at a side opposite to a noise source with respect to the main wall body 1. The sound absorbing units 2 and 3 have a generally rhombic cross-sectional shape of which the apexes are cut off. The cut-off portions are openings 2A and 3A of the first and second units 2 and 3, respectively, which will be described in further detail later.

The sound absorbing units 2 and 3 are disposed laterally with respect to each other with a predetermined spacing between them.

As mentioned above, the first sound absorbing unit 2 is provided on the top of the main wall body 1. As shown, an overhang 4 is provided on a side of the main wall body 1 opposite to the noise source. It extends horizontally in a direction away from the noise source, and further extended by another overhang 5. The overhang 5 extends obliquely upward from the free end of the overhang 4. The second sound absorbing unit 3 is provided at the top end of the overhang 5 as will be seen from FIG. 2.

In this embodiment, the first sound absorbing unit 2 has an internal space 20 while the second unit 3 has an internal space 30. The internal space 30 of the second unit 3 is larger than the internal space 20 of the first unit 2.

Also, the second sound absorbing unit 3 is higher from a ground or base level at which the noise barrier wall is erected than the first unit 2. The overhang 4 may also extend obliquely upward as shown with a chain double-dashed line, not horizontally as shown with the solid line, in FIG. 2. Also, the overhang 5 may extend horizontally as well as obliquely upward.

The first sound absorbing unit 2 comprises two branch walls 21 and 22 extending obliquely upward and substantially linearly from the top of the main wall body 1 to the left and right (in the plane of the drawing), respectively. The branch walls 21 and 22 are terminated by additional branch walls 23 and 24, respectively, which extend from the free ends of the walls 21 and 22, respectively, obliquely upward and substantially linearly towards each other. Thus, the assembly of the branch walls 21 and 22 and the main wall body 1 has such a Y-shaped cross section as shown. The previously-mentioned opening 2A of the first sound absorbing unit 2 is defined between the free ends of the additional branch walls 23 and 24. In this embodiment, the two branch walls 21 and 22 define an angle of 120 deg. between them, while the additional branch walls 23 and 24 form an angle of 90 deg. with respect to the branch walls 21 and 22, respectively. The maximum width (in the plane of the drawing) of the first sound absorbing unit 2 is designed to be 0.5 m.

The second sound absorbing unit 3 comprises two branch walls 31 and 32 extending obliquely upward and substantially linearly from the top of the hangover 5 to the left and right (in the plane of the drawing), respectively. The branch walls 31 and 32 are terminated by additional branch walls 33 and 34, respectively, which extend from the free ends of the walls 31 and 32, respectively, obliquely upward and substantially linearly towards each other. The previously-mentioned opening 3A of the second sound absorbing unit 3 is defined between the free ends of the additional branch walls 33 and 34. In this embodiment, the two branch walls 31 and 32 define an angle of 90 deg. between them, while the additional branch walls 33 and 34 form an angle of 90 deg. with respect to the branch walls 31 and 22, respectively.

Also, the overhang 5 facing the branch wall 22 is not extended parallel with the branch wall 22. This is intended for the sound propagated into the space defined between the branch wall 22 and overhangs 4 and 5 not to reside there as a standing wave.

Figure 3:
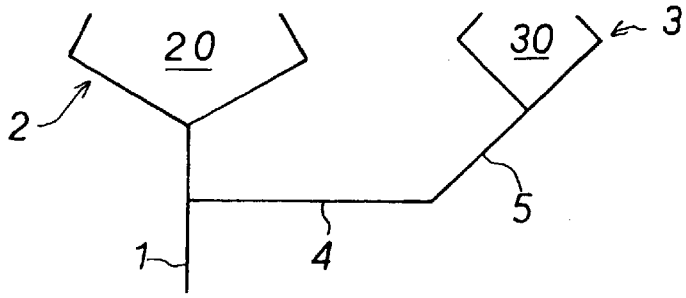
FIG. 3 is a side elevation of a second embodiment of the present invention.

In the second embodiment shown in FIG. 3, similar overhangs 4 and 5 to those in the aforementioned first embodiment are provided, and sound absorbing units 2 and 3 are provided which are designed to have internal spaces 20 and 30, respectively, of a same size. Also the units 2 and 3 have a same height from the ground or base level.

Figure 4:
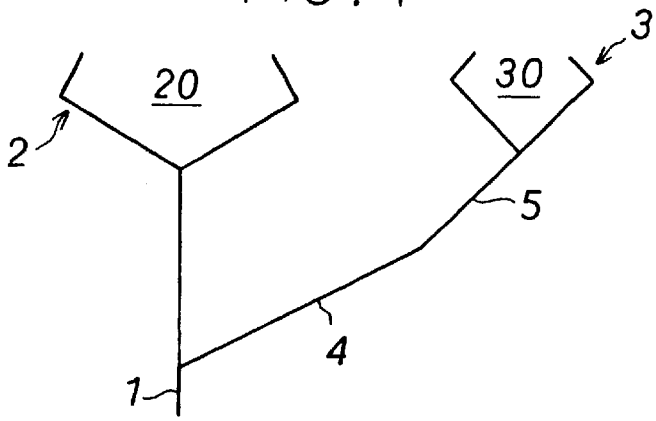
FIG. 4 is a side elevation of a third embodiment of the present invention.

In the third embodiment shown in FIG. 4, an overhang 4 is provided extending obliquely and another overhang 5 is also provided extending obliquely upward. A first sound absorbing unit 2 is provided atop a main wall body 1, and a second sound absorbing unit 3 is provided at the top end of the overhang 5. The second sound absorbing unit 3 is higher from the ground or base level than the first unit 2. The first sound absorbing unit 2 has an internal space 20 and the second sound absorbing unit 3 has an internal space 30. The internal space 30 is smaller than the space 20.

Figure 5:
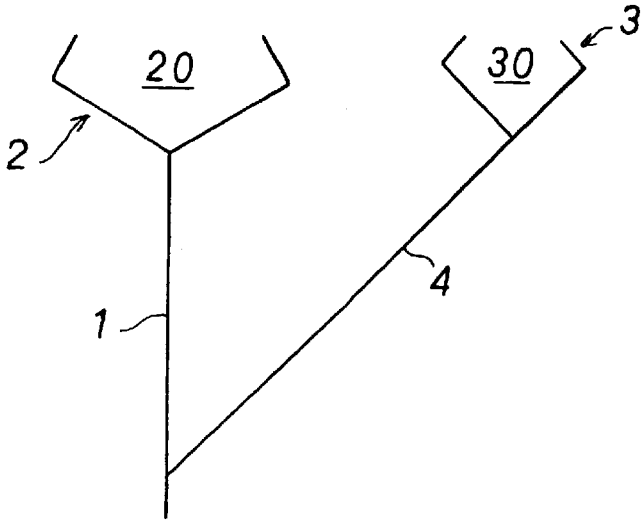
FIG. 5 is a side elevation of a fourth embodiment of the present invention.

In the fourth embodiment shown in FIG. 5, a first sound absorbing unit 2 is provided on the top of a main wall body 1, and a second sound absorbing unit 3 is provided at the top end of an overhang 4 extended obliquely upward. The second sound absorbing unit 3 is higher from the ground or base level than the first unit 2. The second sound absorbing unit 3 has a smaller internal space than a one 20 the first unit 2 has.

Figure 6:
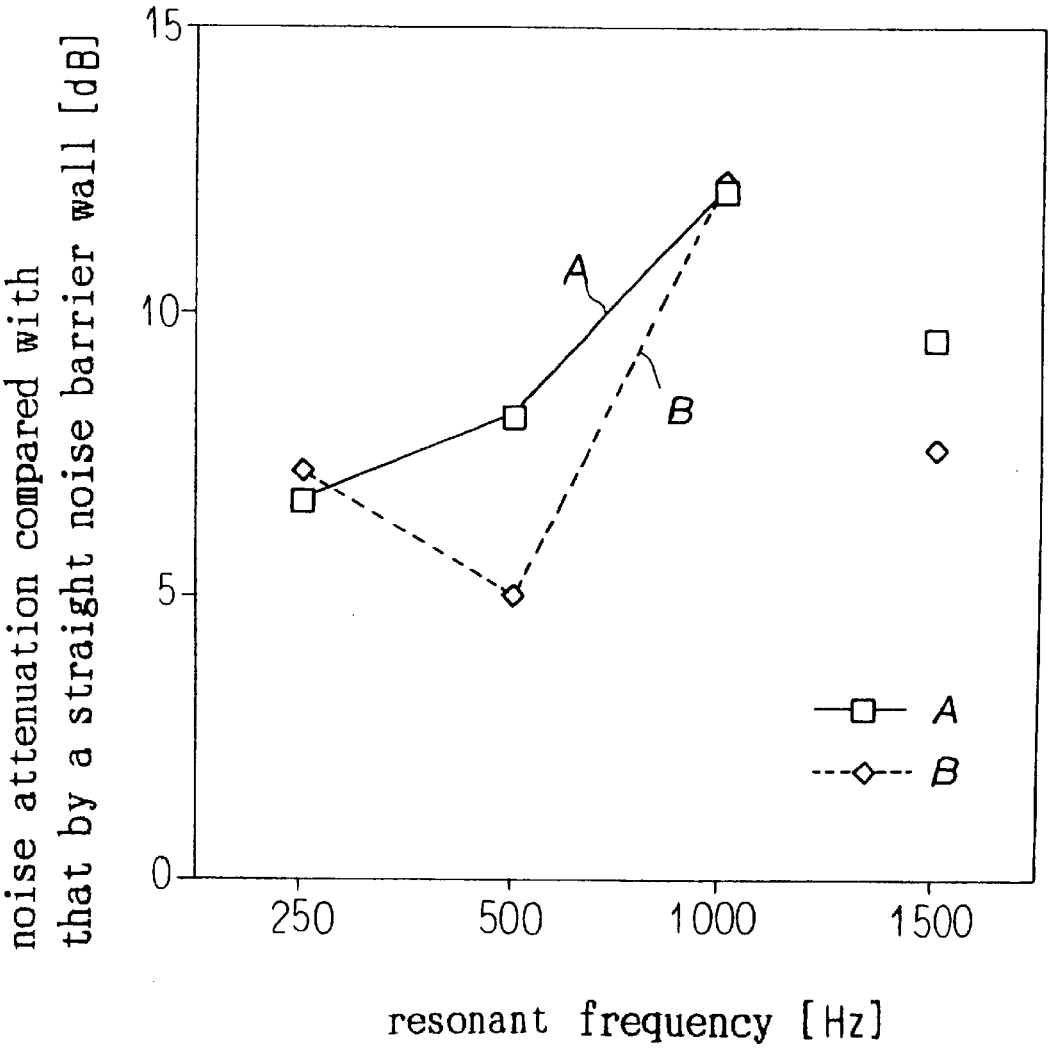
FIG. 6 graphically illustrates achievements of noise attenuation at every resonant frequency, compared with that by a straight noise barrier wall, by each of the noise barrier walls of which one has two sound absorbing units of different internal space sizes while the other has two sound absorbing units of a same internal space.

In FIG. 6, a graph A represents an achievement of noise attenuation (in dB) by the first embodiment, shown in FIG. 2, in which the ratio in size between the internal spaces 20 and 30 is set to be 1:0.6, in comparison with that by a prior-art straight noise barrier wall, while a graph B shows an achievement of noise attenuation (in dB) by a variant of the first embodiment, shown in FIG. 2, in which the construction remained unchanged and the second sound absorbing unit 3 was modified in size to have the internal space 30 which is the same in size as that 20 of the first sound absorbing unit 2, in comparison with that by a prior-art straight noise barrier wall. The straight noise barrier wall was 3 m tall. In the noise barrier walls represented by the graphs A and B, respectively, the first sound absorbing unit 2 was 3 m high from the ground or base level while the second sound absorbing unit 3 was 3.05 (=3+0.05) m high. To measure the noise attenuation, a speaker as a sound source was placed at a position 5 m from the barrier wall and the sound from the speaker was measured at a position 0 m high and 10 m distant from the noise barrier wall in a direction away from the sound source.

It will be apparent from FIG. 6 that as the internal space 20 of the first sound absorbing unit 2 is different in size from the internal space 30 of the second sound absorbing unit 3, the effect of noise attenuation differs depending upon a range of the resonant frequency. By designing the first and second sound absorbing units 2 and 3 to have the internal spaces 20 and 30, respectively, of different sizes so that the resonant frequency in one of the spaces is different from that in the other, the effect of noise attenuation can be prevented from being reduced due to an interference between resonant frequencies within a certain range incidental to the noise barrier wall.

Figure 7:
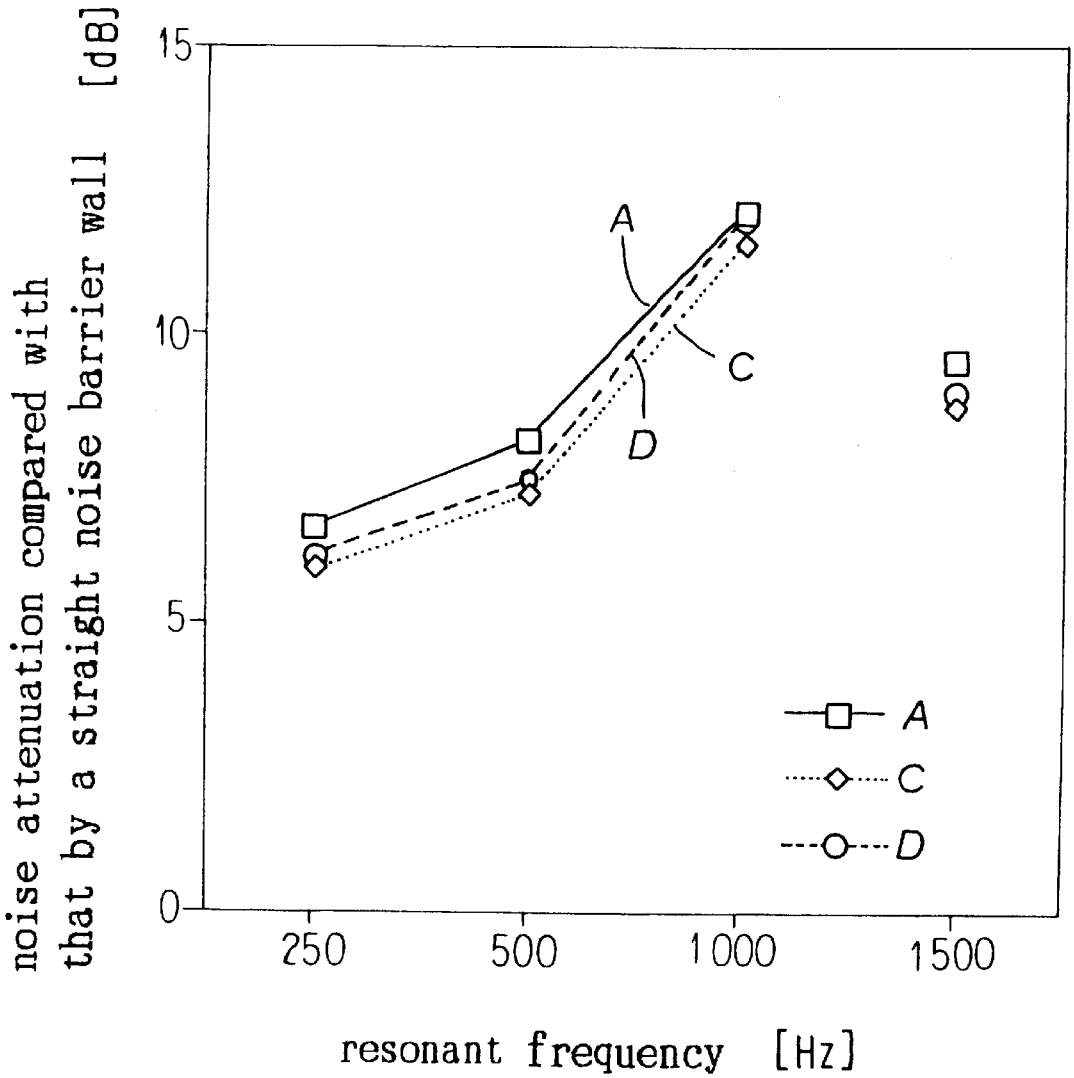
FIG. 7 graphically illustrates achievements of noise attenuation at every resonant frequency, compared with that by a straight noise barrier wall, by each of noise barrier walls of which one has two sound absorbing units of different heights from a ground or base level at which the noise barrier wall is erected, while the other has two sound absorbing units of a same height.

In FIG. 7, a graph C represents an achievement of noise attenuation (in dB) by a noise barrier wall of which the configuration including same first and second sound units as those 2 and 3 in the noise barrier wall represented by the graph A in FIG. 6 and in which the first and second sound units have a same height, that is, both the units are 3 m high from the ground or base level. A graph D shows an achievement of noise attenuation (in dB) by a noise barrier wall in which the first sound unit was as high as in the graph C (3 m) while the second sound unit was 0.05 m higher.

It will also be evident from FIG. 7 that when the opening 3A of the second sound absorbing unit 3 is higher from the ground or base level than the opening 2A of the first sound absorbing unit 2, the noise propagating from a noise source to a side of the noise barrier wall opposite to the noise source could be attenuated more effectively. It should be noted that the measurement of sound attenuation was done in a similar manner to that for preparation of the graphs in FIG. 6.

Figure 8:
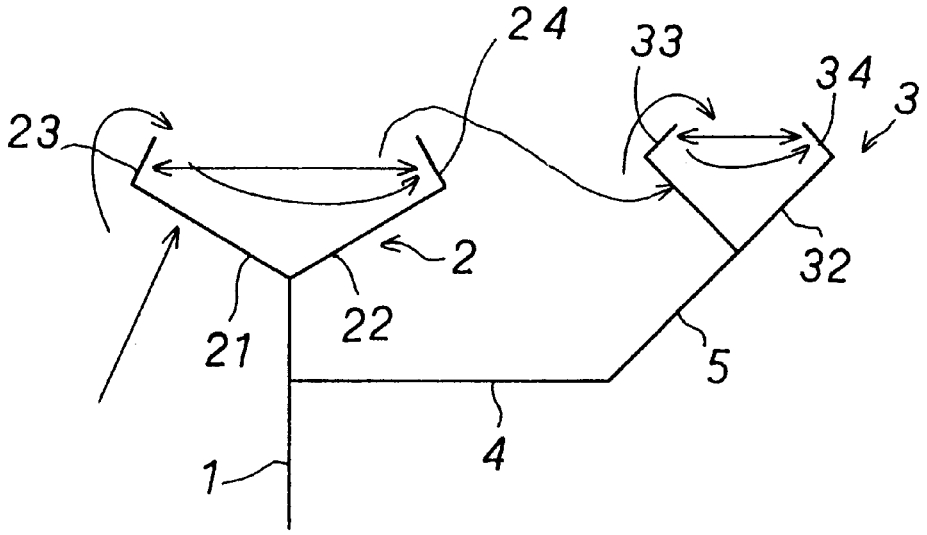
FIG. 8 shows how the noise barrier wall according to the present invention acts to attenuate a noise.

FIG. 8 shows a flow of a sound emergent from a source. The sound from the source is first blocked by the branch wall 21 of the first sound absorbing unit 2. It further propagates around the end of the branch wall 21 and attenuated at that wall end under the effect of diffraction. Then it is blocked by the additional branch wall 23. The sound going around the ends of the branch wall 21 and additional branch wall 23 is attenuated at those ends under the effect of diffraction. It further moves and goes into the space between the additional branch walls 23 and 24. Thus it is blocked by the walls 23 and 24. The sound propagating around the additional branch wall 24 is blocked by the branch wall 31 of the second sound absorbing unit 3, and then attenuated in the same manner as along the first unit 2.

Figure 9:
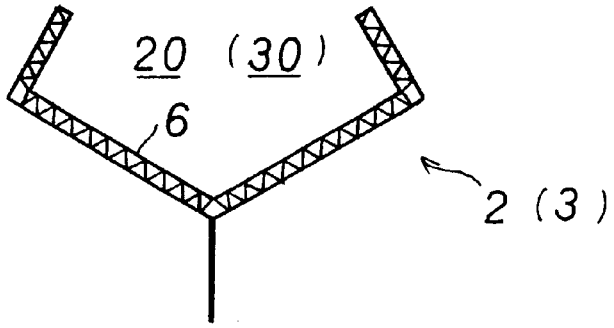
FIG. 9 is a side elevation of a variant of the present invention in which a sound absorbing material is provided in the internal space.

FIG. 9 shows a variant of the present invention in which a sound absorbing material 6 is provided inside the internal space 20 (or 30) of the sound absorbing unit 2 or 3 (or both). As the sound absorbing material, any one should preferably be selected from rock wool, glass wool, ceramic, foamed concrete and the like.

What is claimed is:

1. A noise barrier wall having a main wall body standing generally vertically and provided atop thereof with a first sound absorbing unit, and on a side thereof opposite to a noise source with an overhang extending away from the noise source and of which the free end is directed upward and provided at an end thereof with a second sound absorbing unit, the first sound absorbing unit comprising two branch walls extending obliquely upward to the left and right, respectively, from the top end of the main wall body and each provided at the free end thereof with an additional branch wall, these additional branch walls extending obliquely upward towards each other, an opening being defined between free ends of the additional branch walls; and the second sound absorbing unit comprising two branch walls extending obliquely upward to the left and right respectively, from the top end of the overhang and each provided at the free end thereof with an additional branch wall, these additional branch walls extending obliquely upward towards each other, an opening being defined between free ends of the additional branch walls.

2. The noise barrier wall according to claim 1, wherein the two sound absorbing units are different in internal space size from each other.

3. The noise barrier wall according to either claim 1 or 2, wherein the opening of the sound absorbing unit located at a position opposite to the noise source with respect to the main wall body is disposed at a higher level than that of the absorbing unit nearer to the noise source.

* * * * *